US006029830A

United States Patent [19]

Manookian

[11] Patent Number: 6,029,830

[45] Date of Patent: Feb. 29, 2000

[54] SPORTS EQUIPMENT HANGING BELT

[76] Inventor: Steven S. Manookian, 1865 S. Samara Dr., Rowland Heights, Calif. 91748

[21] Appl. No.: 09/009,382

[22] Filed: Jan. 20, 1998

[51] Int. Cl.[7] ..... A47F 7/00

[52] U.S. Cl. ..... 211/87.01; 211/85.7; 211/118; 248/339; 256/1

[58] Field of Search ..... 211/85.7, 87.01, 211/113, 118; 2/311–317; 248/304, 339, 230.8; D3/215, 221, 222; D2/638; 24/298; 256/1; D6/552; D8/337, 367

[56] References Cited

U.S. PATENT DOCUMENTS

| | | | |
|---|---|---|---|
| D. 365,236 | 12/1995 | Stockwell | 211/113 X |
| D. 377,572 | 1/1997 | Martin | D6/552 |
| D. 401,840 | 12/1998 | Goodman et al. | D8/367 |
| 1,014,004 | 1/1912 | Irwin | 248/102 |
| 2,565,978 | 8/1951 | Meriwether | 248/339 |
| 2,629,154 | 2/1953 | Micucci | 211/118 |
| 3,698,563 | 10/1972 | Gordon et al. | 211/13 |
| 3,746,179 | 7/1973 | Paumgardhen | 211/117 |
| 3,854,588 | 12/1974 | Kinard | 211/85.7 |
| 3,920,166 | 11/1975 | Hogensen, Jr. | 2/312 |
| 4,049,126 | 9/1977 | Halverson | 211/87.01 |
| 4,052,805 | 10/1977 | Potter | 211/118 |
| 4,193,495 | 3/1980 | Keeley | 211/85.7 |
| 4,747,527 | 5/1988 | Trumpower, II | 2/311 |
| 4,932,641 | 6/1990 | Thomas et al. | 24/298 |
| 4,953,817 | 9/1990 | Mosteller | 248/304 |
| 5,137,158 | 8/1992 | Brockway | 248/339 |
| 5,294,005 | 3/1994 | Hedges | 211/85.7 |
| 5,460,274 | 10/1995 | Kramer | 211/113 |
| 5,626,244 | 5/1997 | Mesna et al. | 211/85.7 |
| 5,718,189 | 2/1998 | Blake | 2/312 |
| 5,762,206 | 6/1998 | Leichter | 211/113 |
| 5,823,360 | 10/1998 | Gorosave | 211/113 |

*Primary Examiner*—Daniel P. Stodola
*Assistant Examiner*—Jennifer E. Novosad
*Attorney, Agent, or Firm*—Egar W. Averill, Jr.

[57] ABSTRACT

A sports equipment hanging belt for attachment to a chain link fence. The belt has a hook at each end which hooks into the chain link fence. The belt may then be tightened on the chain link fence. A number of hooks are held to the belt and extend downwardly below the bottom of the belt at least 3 inches so that when sports equipment is hung on a hook the hook will rest against the chain link fence thereby preventing the belt from turning by the weight of the sports equipment.

7 Claims, 2 Drawing Sheets

SPORTS EQUIPMENT HANGING BELT

BACKGROUND OF THE INVENTION

The field of the invention is hanging devices and the invention relates more particularly to devices for hanging sporting equipment, such as baseball gloves, bats, jackets, equipment bags and the like.

Chain link fences are invariably present in baseball parks and other recreational areas. The athletes prefer to hang their equipment on a hook rather than laying it on the ground. As a result, different approaches have been devised for accomplishing this. One such approach is a chain link fence hanger shown in U.S. Pat. No. 4,953,817 which has three arms which hook onto the fence and a hook is supported by the three arms. While this is satisfactory to place a single hook, in most instances an entire team wishes to use the hooks and this single hook approach is quite inefficient.

Another approach is shown in the Hedges U.S. Pat. No. 5,294,005. This utilizes a tube which is hooked onto the fence and the tube supports various hooks which may be used to hang sporting equipment. The tube being rigid, however, is not capable of being folded and thus, is difficult to transport. A bottle holder is shown in U.S. Pat. No. 1,014,004 which is made from an inelastic belt with hooks on each end and the hooks may be placed on an infant's crib or other apparatus to hold a bottle in place.

BRIEF SUMMARY OF THE INVENTION

It is an object of the present invention to provide a device which may be quickly attached to a chain link fence and be capable of holding numerous pieces of sporting goods equipment which device also may be rolled up and held in a sports bag or other small container.

The present invention is for a sports equipment hanging belt for attachment to a chain link fence. The belt includes a length of inelastic webbing having a fence hook shaped to hold onto said chain link fence between the links thereof. The webbing has a fence hook at a second end and a length adjusting clamp between the ends. A plurality of equipment hanging hooks are held along the length of the webbing. Each hook extends down below the lower edge of the length of webbing at least 3" so that when the webbing is tightened horizontally against a chain link fence the hooks abut at least two lengths below the belt to hold the hook and prevent the length of webbing from twisting from the weight of the equipment. Preferably the hooks extend downwardly about 4" and have an outwardly extending portion above the length of webbing.

DESCRIPTION OF THE PREFERRED EMBODIMENTS

Figure 1:
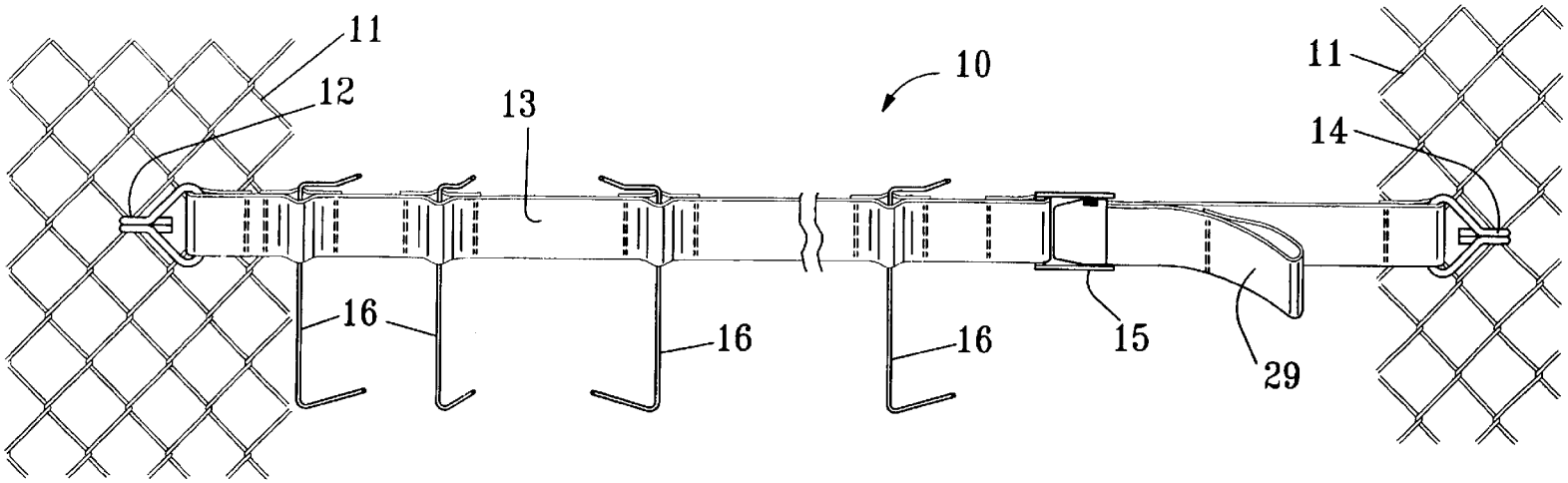
FIG. 1 is a front view of the sports equipment hanging belt of the present invention.

The sports equipment hanging belt of the present invention is shown in front view in FIG. 1 and indicated generally by reference character 10. Belt 10 is held on a chain link fence 11. A hook 12 is affixed to fence 11 at one end and to the length of inelastic webbing 13. At the other end a hook 14 is affixed to fence 11 and a clamp 15 permits the length of inelastic webbing 13 to be tightened along the fence.

Figure 2:
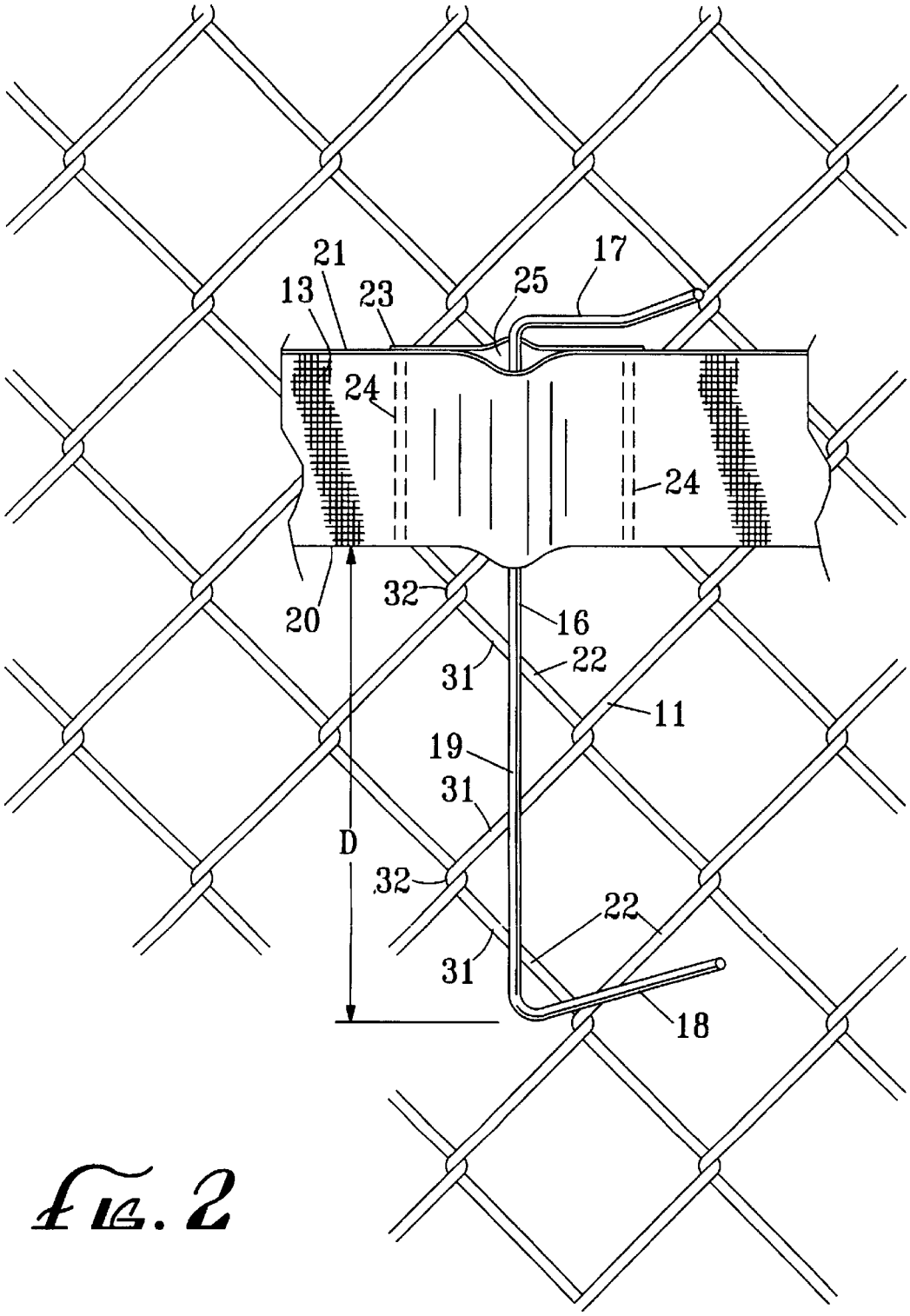
FIG. 2 is an enlarged view of one hook thereof.

An individual equipment hanging hook 16 is shown in enlarged view in FIG. 2. Hook 16 has an upper hook portion 17 and a lower hook portion 18. The shank 19 of hook 16 extends downwardly a distance "D" from the lower edge 20 of webbing 13. The upper edge of the webbing is indicated by reference character 21. The advantage of having length "D" at least 3" means that hook 16 will abut at least two straight portions 31 of a link. The straight portions 31 are connected by bands 32. 22 of fence 11. Thus, when equipment is placed on lower hook 18 it will not tend to turn the belt but instead will cause the hook to rest against the links 22. This is also true if equipment is hung on upper hook portion 17.

The webbing 13 should be capable of supporting the tension placed by clamp 15 and thus, is preferably a length of woven webbing at least about 2" wide. An individual hook 16 is held to the length of webbing 13 by a short length of webbing 23 sewn at 24 to webbing 13. This provides a pocket 25 for holding hook 16. The hook can be fabricated from wire having a diameter of at least ⅛" to provide sufficient strength for holding an equipment bag. The hooks can be provided in different shapes to accommodate the different objects. Because a chain link fence has substantial strength it is possible to support a great deal of weight on the sports equipment hanging belt of the present invention. The belt is preferably at least 6' long and may be made 10' in length to provide sufficient hooks for an entire baseball team. While the hooks should extend downwardly at least 3", they preferably extend downwardly 4" or more. They preferably extend outwardly about 2" to facilitate the hanging of a wide variety of sports equipment.

Figure 3:
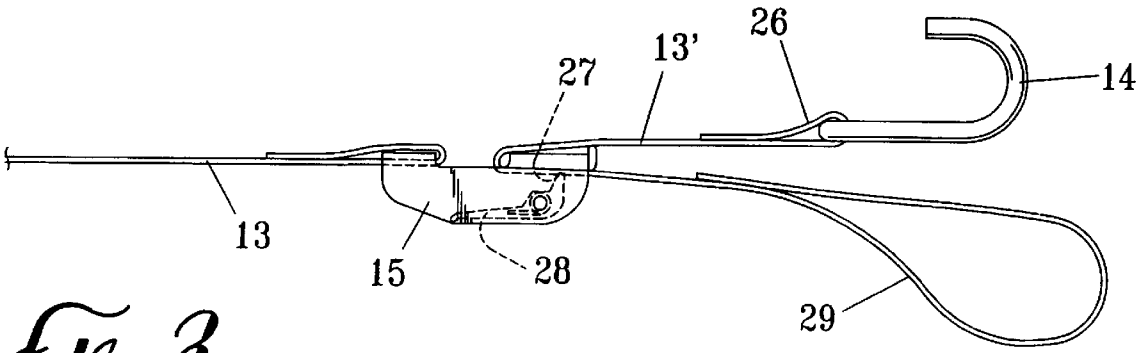
FIG. 3 is an enlarged top view of the clamp portion of the belt of FIG. 1.

In FIG. 3 the tightening mechanism is shown. The length of inelastic webbing 13 has a second short portion indicated by reference character 13'. This is attached by a loop 26 to hook 14. It then passes through a clamp 15 which has a jaw 27 which is opened by pushing downwardly on handle 28. Handle 28 is spring loaded and thus, when released, clamps onto the length 13'. Preferably a loop 29 is provided at the far end to facilitate the tightening step. Thus, to attach the sports equipment hanging belt to fence 11, handle 28 is pushed down and the length 13' pulled out so that it will have sufficient space to be tightened. Next, hooks 12 and 14 are hooked into lengths of the fence to attach the belt in approximately horizontal configuration. Next handle 28 is depressed opening jaw 27 and loop 29 is pulled toward loop 14 to tighten the belt after which handle 28 is released. The design of clamp 15 is such that it also can be pulled without actually depressing handle 28. The result is a belt which is tightly held against the surface of fence 11 and when equipment is placed on hooks 16, the shank of the hooks remain relatively vertical because of the support provided by fence 11.

The result is a sports equipment bag hanging belt which may be readily folded up and placed in an equipment and yet is easily attached to a fence. The number of hooks and spacing of hooks can be varied depending upon the particular type of equipment to be hung on the belt.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A sports equipment hanging belt attached to a chain link fence comprising:

said chain link fence being made from zig-zagged vertical links having straight portions separated by bands forming diamond shaped openings;

a length of inelastic webbing having a fence hook, hooked onto a link of said chain link fence, said fence hook being held to a first end of said length and having a fence hook at a second end thereof also being hooked onto a link of said chain link fence and a length-adjusting clamp being held by said length of webbing between said first and second ends and said length of inelastic webbing having an upper edge and a lower edge; and a plurality of equipment hanging hooks held along said length of inelastic webbing, each equipment hanging hook extending downwardly below the lower edge of said length of webbing at least 3 inches whereby when said length of inelastic webbing is tightened horizontally along a surface of said chain link fence with said equipment hanging hooks extending downwardly, each of said equipment hanging hooks abuts at least two straight portions of said fence to prevent the equipment hanging hook from tending to rotate the length of inelastic webbing.

2. The sports equipment hanging belt of claim 1 wherein at least some of said equipment hanging hooks have an upper equipment hanging hook extending above said upper edge of said length of inelastic webbing and extending outwardly from said webbing and have a straight central shank.

3. The sports equipment hanging belt of claim 2 wherein each of said equipment hanging hooks is held to said length of inelastic webbing by a length of webbing affixed to a front edge of said length of inelastic webbing attached along both sides of said straight central shank.

4. The sports equipment hanging belt of claim 3 wherein said belt is at least six feet long.

5. The sports equipment hanging belt of claim 1 wherein a width of said length of inelastic webbing is about two inches wide.

6. The sports equipment hanging belt of claim 1 wherein each of said equipment hanging hooks extends about four inches downwardly below the lower edge of said length of inelastic webbing.

7. The sports equipment hanging belt of claim 6 wherein each equipment hanging hook has a lower hook portion which extends outwardly from said chain link fence about two inches.

* * * * *